US012637282B2

(12) United States Patent
Liu et al.

(10) Patent No.: US 12,637,282 B2
(45) Date of Patent: May 26, 2026

(54) MODULAR CABIN TRANSFER DEVICE SUITABLE FOR LARGE LUXURY CRUISE SHIPS

(71) Applicant: JIANGSU UNIVERSITY OF SCIENCE AND TECHNOLOGY, Zhenjiang (CN)

(72) Inventors: Kun Liu, Zhenjiang (CN); Tongqiang Yu, Zhenjiang (CN); Jiaxia Wang, Zhenjiang (CN); Yue Lu, Zhenjiang (CN); Junyi Sha, Zhenjiang (CN)

(73) Assignee: JIANGSU UNIVERSITY OF SCIENCE AND TECHNOLOGY, Zhenjiang (CN)

( * ) Notice: Subject to any disclaimer, the term of this patent is extended or adjusted under 35 U.S.C. 154(b) by 494 days.

(21) Appl. No.: 18/230,711

(22) Filed: Aug. 7, 2023

(65) Prior Publication Data

US 2024/0002020 A1 Jan. 4, 2024

(30) Foreign Application Priority Data

Jan. 17, 2023 (CN) ..... 202310059890.2

(51) Int. Cl.

*B65D 90/14* (2006.01)
*B63B 29/02* (2006.01)
*B65D 90/18* (2006.01)

(52) U.S. Cl.

CPC ..... *B65D 90/143* (2013.01); *B63B 29/025* (2013.01); *B65D 90/14* (2013.01); *B65D 90/146* (2013.01); *B65D 90/18* (2013.01)

(58) Field of Classification Search

CPC ..... B63B 29/025; B65D 90/14; B65D 90/03; B65D 90/146; B65D 90/18; B60P 1/6445; B60P 3/40

See application file for complete search history.

(56) References Cited

U.S. PATENT DOCUMENTS 3,631,999 A * 1/1972 Walerowski ..... B65D 90/146 280/43.11
4,516,901 A * 5/1985 Riedl ..... B65D 90/143 414/458
11,046,515 B2 * 6/2021 Luckinbill ..... B66F 3/46

FOREIGN PATENT DOCUMENTS

GB 2084110 A * 4/1982 ..... B65D 90/143

* cited by examiner

*Primary Examiner* — Ajay Vasudeva
(74) *Attorney, Agent, or Firm* — CBM PATENT CONSULTING, LLC

(57) ABSTRACT

A modular cabin transfer device suitable for large luxury cruise ships includes transfer vehicles and pull rods, where each of the transfer vehicles includes a clamping device, clamping assemblies, and a driving assembly, the upper and lower ends of the clamping device are respectively provided with the clamping assemblies, the clamping device makes the clamping assemblies at the upper and lower ends thereof move toward each other or move backwards, and the clamping assemblies at the upper and lower ends thereof clamp the cabin; the driving assembly is arranged at the lower end of the clamping device, and is configured to drive the transfer vehicle to move; adjacent transfer vehicles are connected by the pull rods.

10 Claims, 9 Drawing Sheets

MODULAR CABIN TRANSFER DEVICE SUITABLE FOR LARGE LUXURY CRUISE SHIPS

CROSS-REFERENCE TO RELATED APPLICATIONS

This application claims priority to Chinese Patent Application Ser. No. CN2023100598902 filed on 17 Jan. 2023.

TECHNICAL FIELD

The present invention relates to the technical field of ship equipment, and particularly relates to a modular cabin transfer device suitable for large luxury cruise ships.

BACKGROUND ART

The construction of a large cruise ship is complex and the internal structure thereof is compact. In the actual process of constructing each deck of the cruise ship, it is difficult to transfer cabin modules, because each deck has a limited space but a complicated structure. Furthermore, a thin-slab structure is mostly adopted inside the cruise ship, resulting in that when the cabin modules are transported, they are prone to collisions and cause safety accidents. The traditional mode of manual crowbar handling will not only waste a lot of manpower and material resources, but also will hinder the actual operation. To meet such special requirements, it is needed to design a cabin module transfer device for cruise ships.

In some of the prior art, crowbars and hydraulic vehicles are mostly used for the transfer of cabin modules. Therefore, the use of traditional transfer tools and transfer solutions easily leads to deformation or damage of modular cabins, thus resulting in unnecessary cost increase and easy damage to the deck surface of the ship; and in addition, during the movement of existing hydraulic vehicles, self-made trolleys are usually used to transport large cabins, but manual pushing of cabins is needed, resulting in that safety accidents are likely to occur, and the cabin modules are prone to deflection during transfer or after abnormal stress, and even falling off the trolleys. Therefore, to ensure the smooth transfer of a cabin, it is urgent to reliably connect and fix a plurality of parts of the cabin, and to reduce the damage to the interior of the cruise ship.

SUMMARY

To solve the above problems existing in the prior art, the present invention provides a modular cabin transfer device suitable for large luxury cruise ships. The present invention solves the problems that the traditional mode of manual crowbar handling will waste a lot of manpower and material resources, the use of traditional transfer tools and transfer solutions easily leads to deformation or damage of modular cabins, thus resulting in unnecessary cost increase, and cabin modules may be detached or damaged during transfer.

The objective of the present invention is achieved by means of the following technical solution: a modular cabin transfer device suitable for large luxury cruise ships, including at least four transfer vehicles and at least four pull rods; each of the transfer vehicles includes a clamping device, clamping assemblies, and a driving assembly, the upper and lower ends of the clamping device are respectively provided with the clamping assemblies, the clamping device makes the clamping assemblies at the upper and lower ends thereof move toward each other or move away from the each other, and the clamping assemblies at the upper and lower ends thereof clamp the cabin; the driving assembly is arranged at the lower end of the clamping device, and is configured to drive the transfer vehicle to move; and when the at least four transfer vehicles are combined, adjacent transfer vehicles are connected by the pull rods.

Preferably, the transfer vehicle is provided with a monitoring unit, a central control unit, and a warning device, where the monitoring unit, the central control unit, and the warning device are electrically connected; the monitoring unit includes an infrared transmitter, an infrared receiver, an infrared range finder, and a camera, where the infrared transmitter and the infrared receiver are installed in one-to-one correspondence, and the infrared range finder and the camera are arranged on the driving assembly; the central control unit is connected with the clamping device and the driving assembly, and controls the clamping device and the driving assembly to work.

An infrared emitter is installed on one of the transfer vehicles, and an infrared receiver is installed on the adjacent transfer vehicle at a position corresponding to the infrared emitter, so that the signal sent by the infrared emitter is received by the infrared receiver; and infrared light emitted by the infrared emitter reaches the infrared receiver on the opposite side. Before the module transfer, it can be reasonably perceived whether the positions of all transfer vehicles are reliable according to the states of emitting and receiving the infrared light. In the transfer process, when the cabin is subject to abnormal stress or deformation, or is about to come into contact with any surrounding objects, if the infrared light emitted by the infrared transmitter cannot be received by the infrared receiver, then it means that the current transfer status is unreliable, and in this case, the central control unit controls the warning device to give an alarm. The infrared range finder and the camera installed on a self-propelled wheel observe in real time whether there is any obstacle in the transfer direction, measure the distance of the obstacle if any, and detect the state of the cabin during the transfer and the positions of the surrounding objects. When the monitoring unit detects any abnormality of the cabin in the transfer process, the central control unit controls the power assembly to stop moving, and at the same time, sends out an alarm signal through the warning device. This device is applied for the transfer of modular cabins, which can better monitor the status of the cabin and effectively avoid the damage to the cabin and the objects in the cruise ship, so that the overall cabin transfer process is more reliable and convenient. The warning device in the technical solution is in the prior art, and those skilled in the art can make conventional choices according to needs, which will not be described in detail here. The warning device is not shown in the figure, and its specific installation position only needs to be clearly visible. The warning device can be an audible and visual alarm or a warning lamp.

Preferably, the clamping device includes a fixed block, a driving motor, a tie rod, a socket block, movable blocks, a slideway, and a connecting block; the inside of the fixed block is of a cavity structure; the driving motor is installed on the top of the fixed block, the tie rod is arranged in an inner cavity of the fixed block, a driving end of the driving motor is connected to one end of the tie rod, and the tie rod is capable to rotate in the inner cavity of the fixed block along its axis; an outer wall of the socket block is fixedly installed in the inner cavity of the fixed block, and an inner wall of the socket block is sleeved in the middle of the tie rod through rotation of a bearing; the movable block is provided with internal threads, the movable blocks are respectively arranged on the upper and lower ends of the tie rod, the slideway is arranged between the movable blocks at the upper and lower ends, and the movable block is capable to move along the linear direction of the slideway; the connecting block is arranged at the end of the movable block away from the tie rod, and the clamping assembly is connected with the clamping device through the connecting block.

Preferably, the fixed block is in an "L" shape, and the driving motor is installed in a bending part on the top of the fixed block; and a coupling is arranged between the driving end of the driving motor and one end of the tie rod.

When being started, the driving motor will drive the tie rod to rotate. The tie rod has a structure with opposite threads at both ends, or a positive/negative teeth screw structure known to those skilled in the art. The tie rod in the process of rotation drives the movable blocks at both ends move towards each other or backwards, and the slideway ensures that the movable blocks at the upper and lower ends move along a straight line. Since the movable block, the connecting block, and the clamping assembly are connected in different places, the clamping assemblies located at the upper and lower ends of the fixed block also move toward each other or backwards during this movement, so that the clamping assemblies at the upper and lower ends are clamped at the clamping positions of the cabin, and the process of fixing the vehicle body and the cabin is completed. When the movable blocks at the upper and lower ends gradually approach, the socket block is capable to prevent the movable blocks at the upper and lower ends from colliding.

Preferably, the clamping assembly includes a connecting rod, a support block, a clamping plate, and a fixed base; one end of the connecting rod penetrates the fixed base and is connected to the clamping device, the connecting rod is slidably arranged in the fixed base, the other end of the connecting rod is connected to the support block, and the inner side of the support block is provided with the clamping plate; the fixed base is arranged on the inner side of the clamping device, the end portion of the fixed base is provided with a limiting strip, and the limiting strip is slidably connected with the side wall of the support block.

Preferably, the clamping plate includes a horizontal abutment plate and two longitudinal abutment plates, where the two longitudinal abutment plates are vertically connected and arranged at the bottom of the horizontal abutment plate, and inner walls of the horizontal abutment plate and the longitudinal abutment plate are provided with soft cushions; and the inner side of the fixed base is provided with a supporting plate.

The clamping plate has an "L"-shaped structure. One horizontal abutment plate and two longitudinal abutment plates are in full contact with the three outer walls at the corners of the cabin, which enables to reliably clamp all corners of the cabin. The soft cushion and the supporting plate protect the fixed positions of the cabin to prevent deformation of or damage to the cabin in the process of fixing or transfer. In addition, a pressure sensor is installed on the inner wall of the soft cushion or the outer wall of the clamping plate, and the pressure sensor is connected to the monitoring unit, and is capable to measure the effect of contact between the cabin and the transfer tool. In the transfer process, many positions of the cabin are unevenly stressed. According to acquired data of stress when the cabin and the transfer tool are in contact, the degree of stress between the transfer vehicle and the cabin can be determined, so as to avoid damage to the cabin due to the structural factors of the transfer vehicle. When the pressure exceeds the threshold pressure in the central control unit, the central control unit controls the warning device to give an alarm.

Preferably, the driving assembly includes a support rod, a power assembly, and a self-propelled wheel; the power assembly includes a battery, a steering device, and a power device; the power assembly is connected to the clamping device through the support rod, and the power assembly enables the self-propelled wheel to rotate; the self-propelled wheel is arranged at the bottom of the power assembly, the battery is electrically connected to a rotating device and the power device, and the rotating device and the power device are both connected to the self-propelled wheel. After the power is turned on, the self-propelled wheel is capable to rotate and move by itself, so as to realize the automatic transfer of the whole modular cabin.

Preferably, universal wheels are arranged at the bottom of the driving assembly. The universal wheel can be installed on both sides of the self-propelled wheel, to ensure the stability of the transfer, and to make it possible to be pushed by manually grabbing the handle thereof after the power is cut off.

Preferably, a handle is arranged on the outer side of the clamping device.

Preferably, the pull rod is a telescopic rod, a knob is arranged between telescopic joints of the pull rod, hooks are respectively arranged at both ends of the pull rod, a rotating shaft is arranged on the side of the clamping assembly, and the pull rod is clamped on the rotating shaft by means of the hook. When the transfer vehicles are used in combination, the two ends of the pull rod are movably connected to the rotating shafts of the clamping assemblies of two adjacent transfer vehicles through the hooks, and the pull rod can be movably connected to the rotating shafts of the upper and lower clamping assemblies of the same transfer vehicle during storage.

The present invention has the following beneficial effects: (1) in the modular cabin transfer device suitable for large luxury cruise ships provided by the present invention, the clamping device is connected with the clamping assembly, the clamping device is configured to control the clamping assembly to reliably clamp eight corners of the cabin, and then the clamping assemblies at the eight corners of the cabin are connected by means of the pull rods, so that the transfer vehicle and the cabin are completely fixed. The overall fixing process is simple and convenient. After clamping, all the corners of the cabin are wrapped and protected by a plurality of clamping assemblies to form a reliable clamping structure, which is capable to cope with the thrust exerted by the moving staff from a plurality of angles, and to prevent the cabin from shifting and falling off caused by abnormal stress. During the transfer of the cabin, it fits better with the transfer tool, and it is easier to control the transfer path. At the same time, the soft cushion and the supporting plate are capable to prevent the cabin from being deformed in the process of clamping or transfer, or to avoid injuries of operators by the corners of the cabin during the transfer process.

(2) In the modular cabin transfer device suitable for large luxury cruise ships provided by the present invention, the central control unit is configured to receive control instructions from a controller, and the central control unit is capable to control the clamping device to clamp the cabin by means of the clamping assembly, and also to drive the power device and the steering device to move the transfer vehicle. When four transfer vehicles are in a fixed installation state against the cabin, the power support of the driving assembly enables to reduce the staff's effort in moving the cabin, so that the overall transfer process is easier and more relaxing. In addition, the clamping device of the present invention is provided with a handle outside, and when the power is cut off, the operator can temporarily grasp the handle and transfer the cabin through the universal wheel.

(3) In the present invention, the monitoring unit and the central control unit are both located on the transfer vehicle, where the monitoring unit is capable to verify the installation position of the transfer vehicle, and to ascertain whether all the transfer vehicles are in reliable transfer fit locations before moving, because the cabin may collide with other objects, doors and walls in the cruise ship during the movement process due to terrain, uneven force and other reasons. The monitoring unit is capable to verify the position of the transfer vehicle before the movement. In addition, the infrared range finder and the camera installed on a self-propelled wheel observe in real time whether there is any obstacle in the transfer direction, measure the distance of the obstacle if any, and detect the state of the cabin during the transfer and the positions of the surrounding objects. When the monitoring unit detects any abnormality of the cabin in the transfer process, the central control unit controls the power assembly to stop moving, and at the same time, sends out an alarm signal through the warning device. This device is applied for the transfer of modular cabins, which can better monitor the status of the cabin and effectively avoid the damage to the modular cabin, so that the overall cabin transfer process is more reliable and convenient.

(4) The pressure sensor of the present invention is capable to measure the effect of contact between the cabin and the transfer tool. In the transfer process, many positions of the cabin are unevenly stressed. In this example, according to acquired data of stress when the cabin and the transfer tool are in contact, the degree of stress between the transfer vehicle and the cabin can be determined, so as to avoid damage to the cabin due to the complex factors of the transfer vehicle. When the pressure exceeds the threshold pressure in the central control unit, the central control unit controls the warning device to give an alarm.

(5) The overall fixing process of the present invention is simple and easy to implement. The present invention solves the problems that during the movement of existing hydraulic vehicles, self-made trolleys are usually used to transport large cabins, but manual pushing of cabins is needed, resulting in that safety accidents are likely to occur, and the cabin modules are prone to deflection during transfer or after abnormal stress, and even falling off the trolleys. In addition, the present invention solves the existing problem that the surface of the cabin is deformed or the surface of the ship deck is damaged during the transfer of cabin modules.

IN THE FIGURES

1. fixed block, 2. fixed base, 3. limiting strip, 4. clamping assembly, 41. connecting rod, 42. support block, 43. clamping plate, 44. soft cushion, 45. rotating shaft, 5. supporting plate, 6. support rod, 7. power assembly, 71. battery, 72. steering device, 73. power device, 8. self-propelled wheel, 81. infrared range finder, 82. camera, 9. universal wheel, 10. cabin, 11. clamping device, 111. driving motor, 112. tie rod, 113. socket block, 114. movable block, 115. slideway, 116. connecting block, 12. handle, 13. infrared transmitter, 14. infrared receiver, 15. pull rod, 16. knob, and 17. hook.

DETAILED DESCRIPTION OF THE EMBODIMENTS

The present invention will be further described below in conjunction with accompanying embodiments, but the embodiments are not taken as a basis for limiting the present invention.

A person skilled in the art should understand that the embodiments of the present application may be provided in the form of a method, a system or a computer program product. Therefore, the present application may use a form of a complete hardware embodiment, a complete software embodiment or an embodiment combining software and hardware. Moreover, the present application may use a form of a computer program product that is implemented on one or more computer-usable and computer-readable storage media (including but not limited to a disk memory, a CD-ROM, an optical memory or the like) that include the computer-usable program code.

Figure 1:
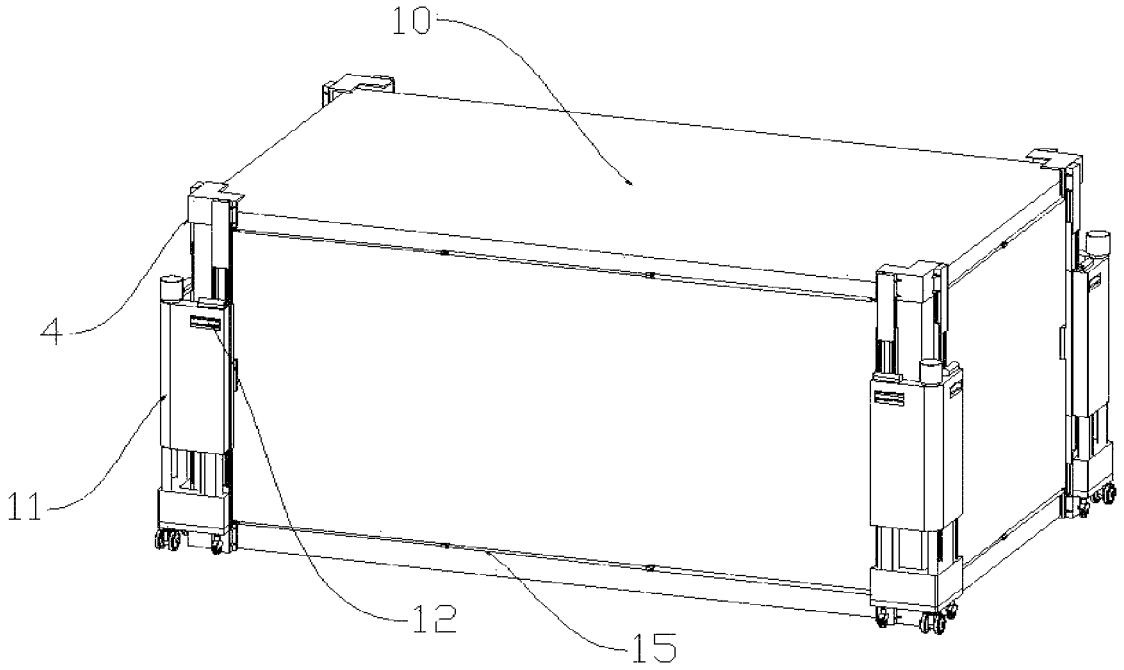
FIG. 1 is a schematic diagram of the structure of a combination of a cabin with a modular cabin transfer device suitable for large luxury cruise ships provided by an embodiment of the present invention.
Figure 2:
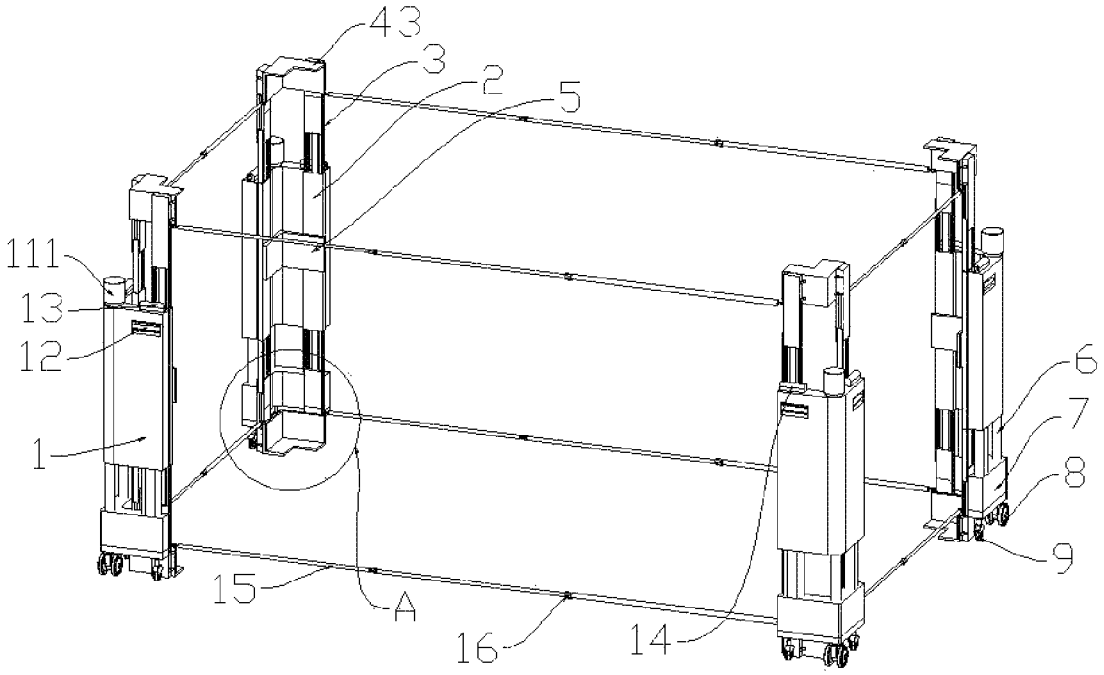
FIG. 2 is a schematic diagram of the structure of a combination of a transfer vehicle with a pull rod provided by an embodiment of the present invention.
Figure 3:
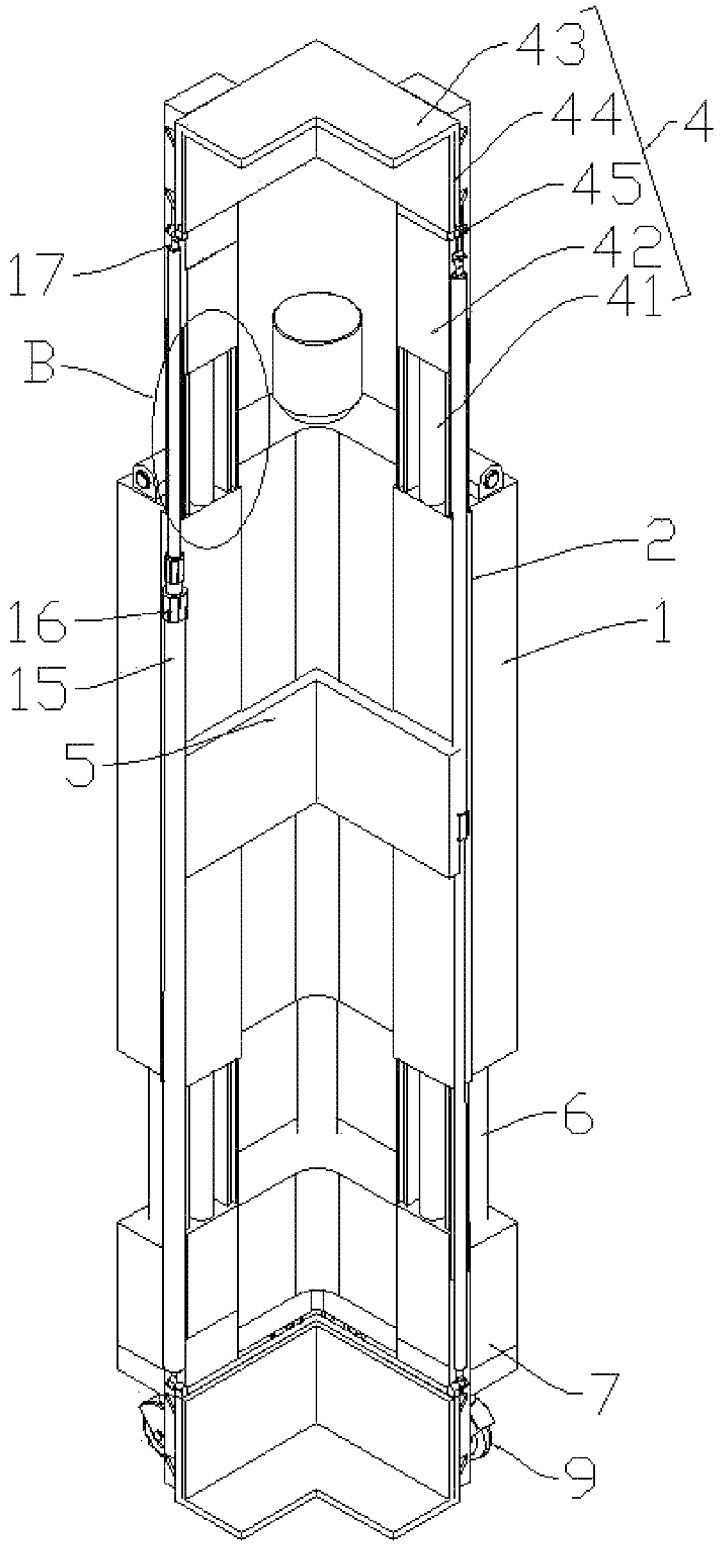
FIG. 3 is a schematic diagram of the structure of a single transfer vehicle provided by an embodiment of the present invention.
Figure 4:
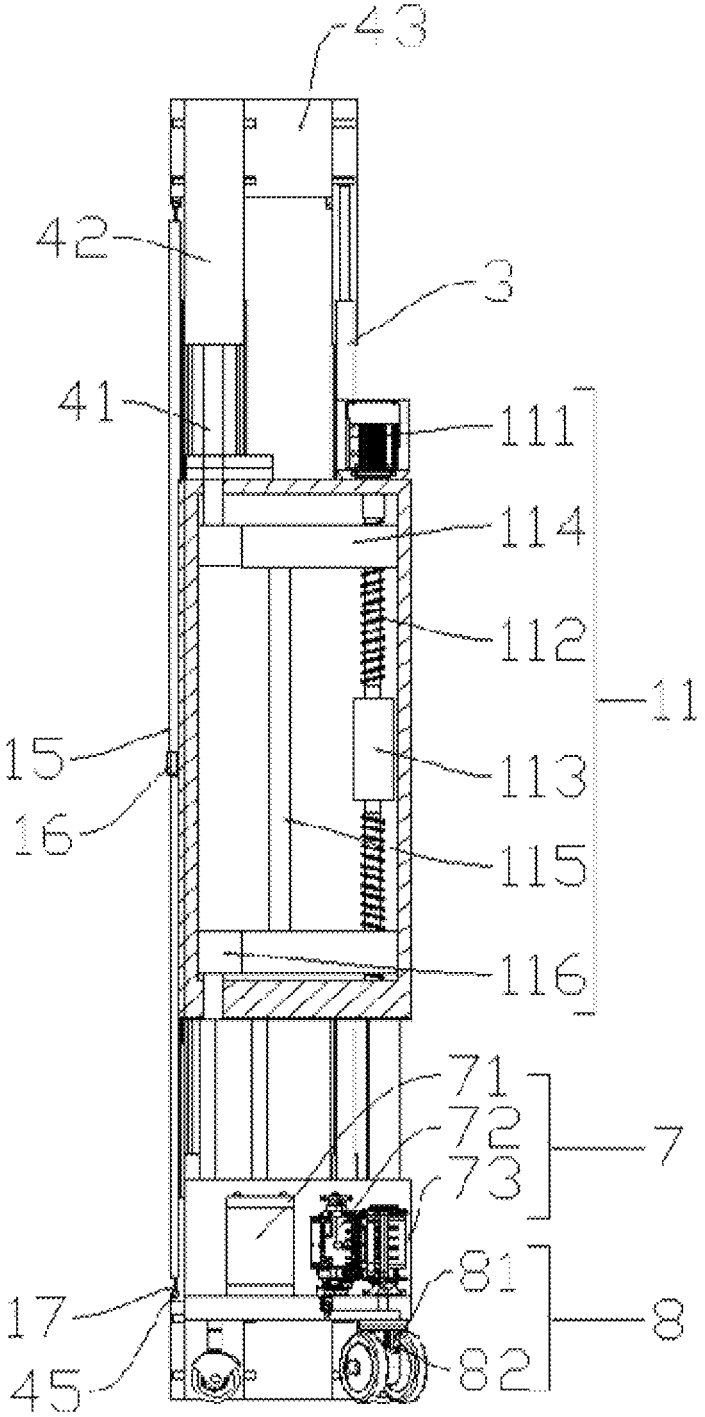
FIG. 4 is a schematic diagram of the structure of a clamping device and a driving assembly provided by an embodiment of the present invention.
Figure 5:
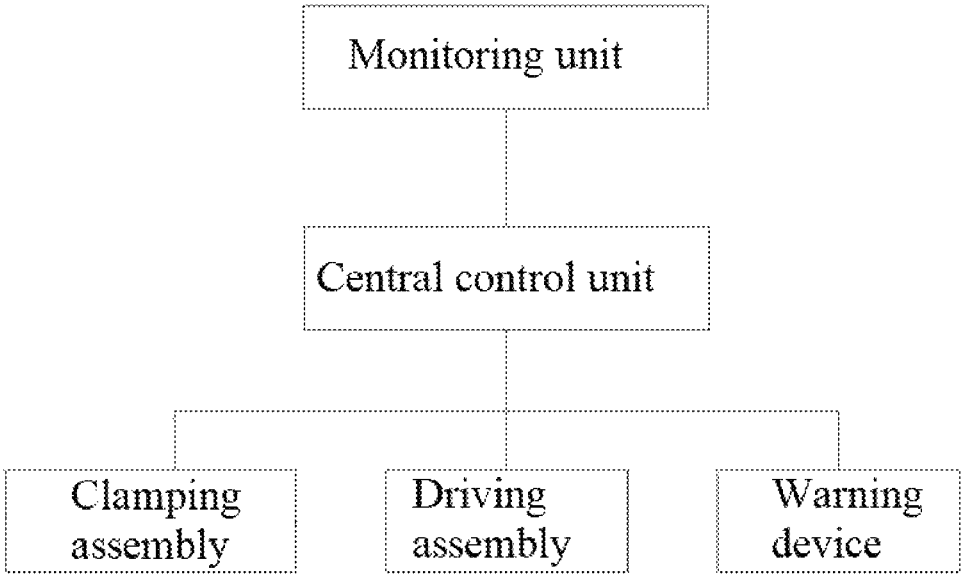
FIG. 5 is a structural block diagram of the modular cabin transfer device suitable for large luxury cruise ships provided by an embodiment of the present invention.
Figure 6:
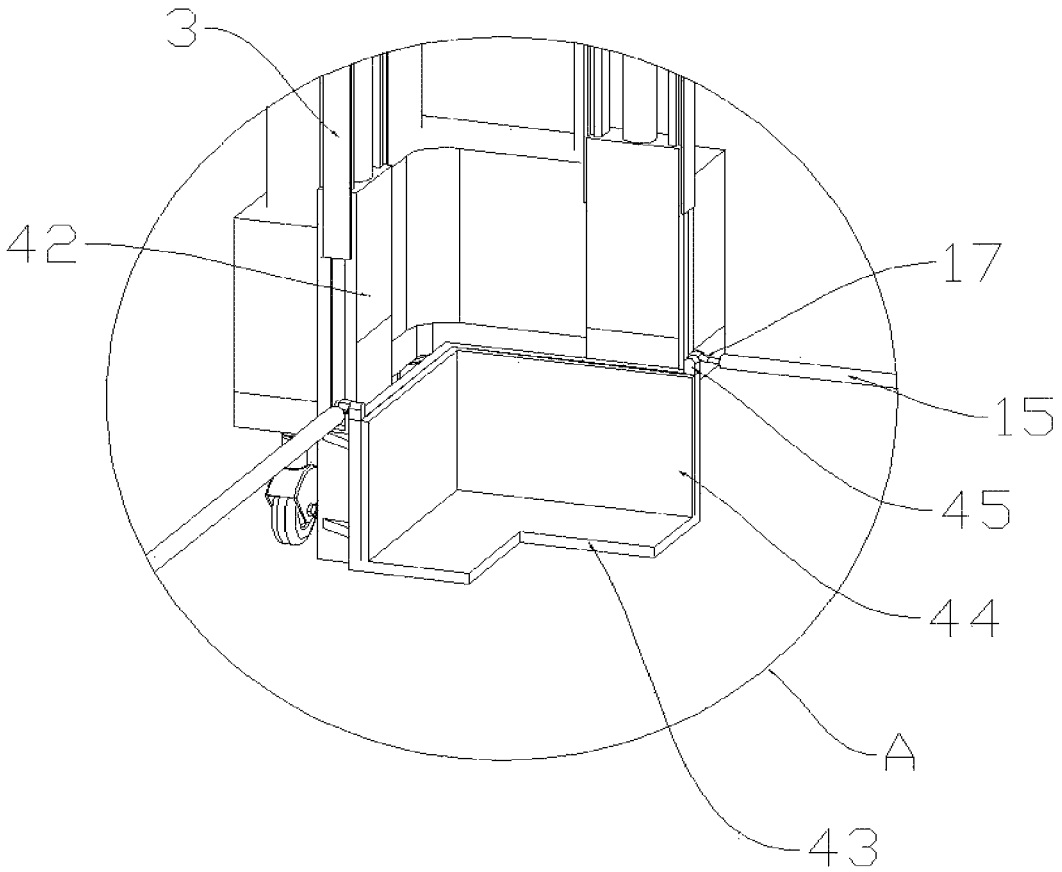
FIG. 6 is an enlarged view of A in FIG. 2.
Figure 7:
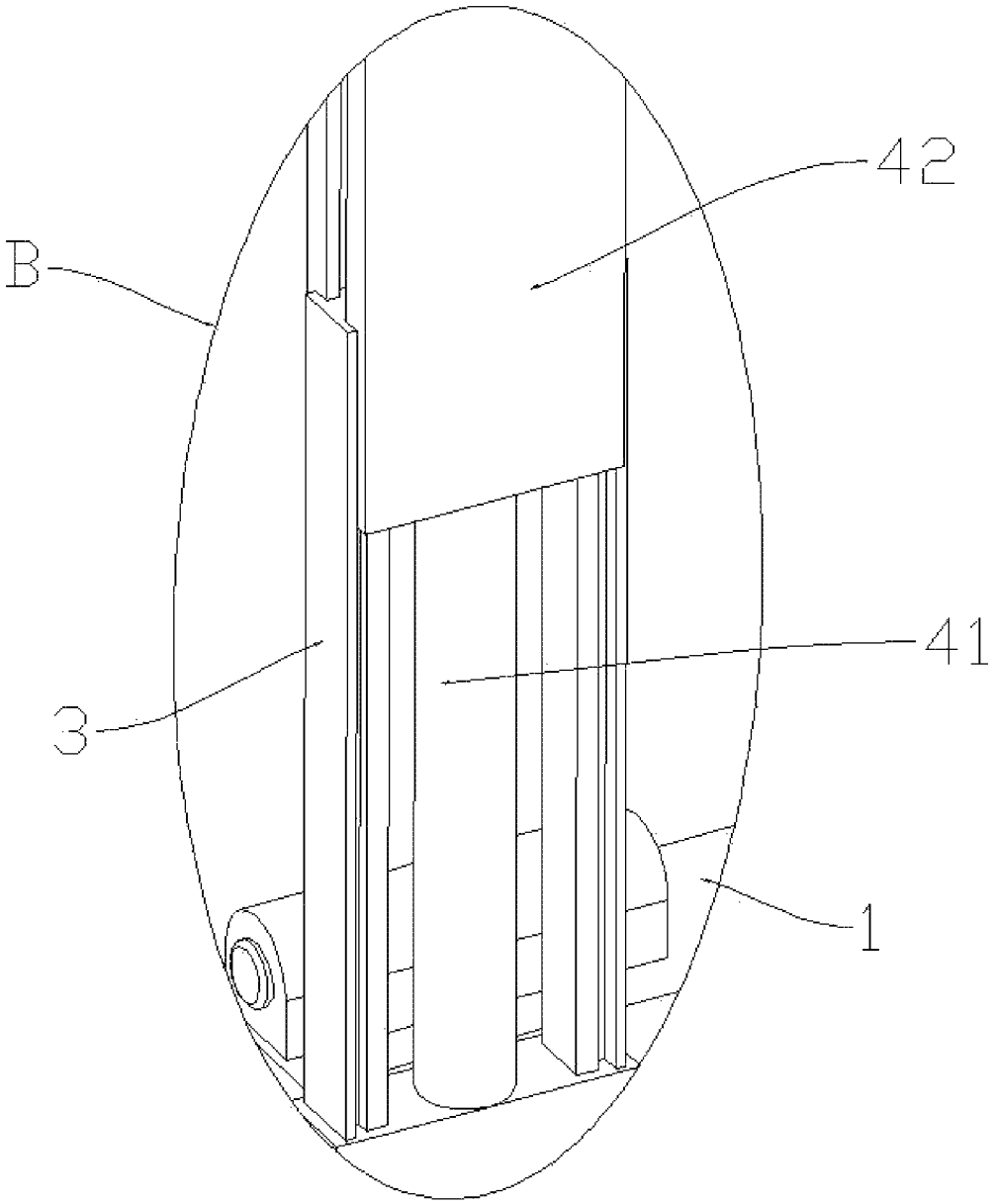
FIG. 7 is an enlarged view of B in FIG. 3.
Figure 8:
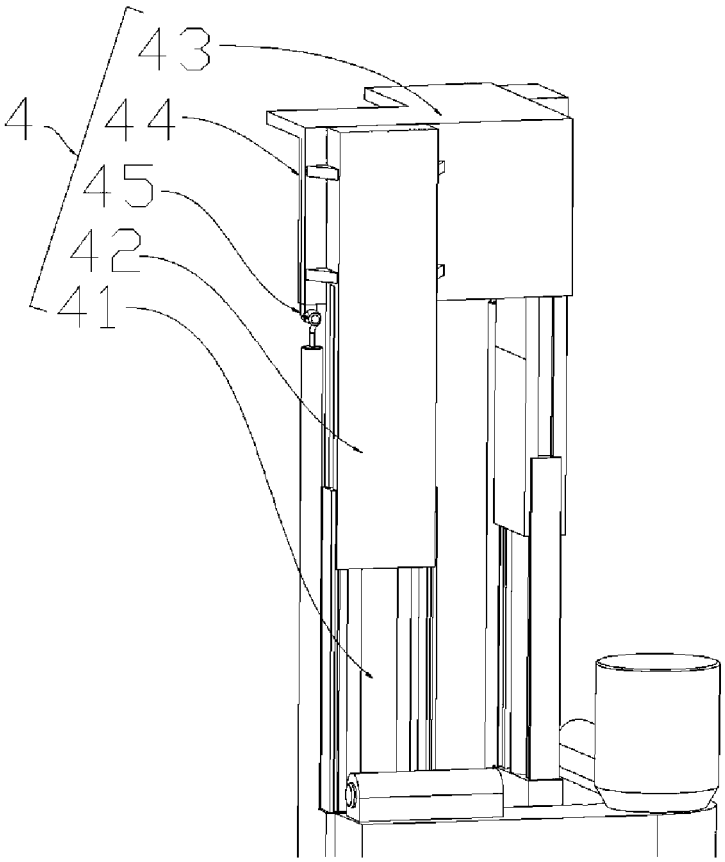
FIG. 8 is a schematic diagram of an enlarged structure of a hook and a rotating shaft provided by an embodiment of the present invention.
Figure 9:
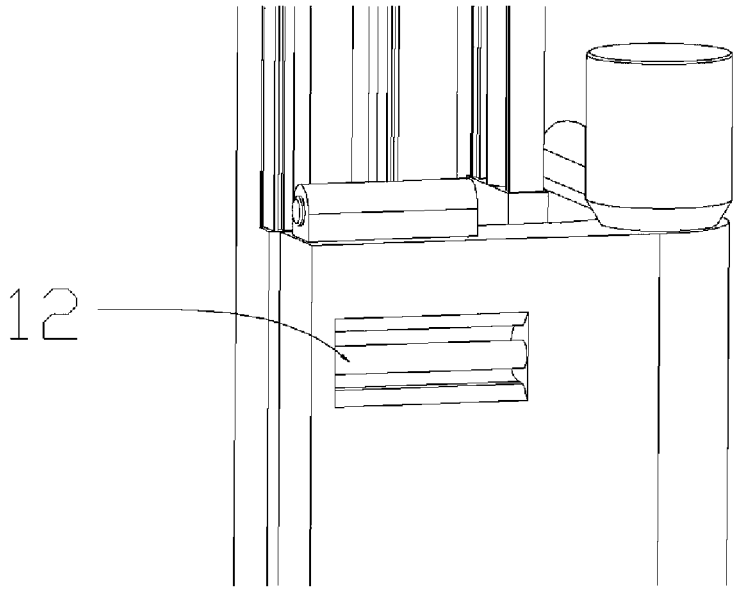
FIG. 9 is a schematic diagram of an enlarged structure of a handle provided by an embodiment of the present invention.

As shown in FIG. 1-7, a modular cabin transfer device suitable for large luxury cruise ships includes 4 transfer vehicles and 8 pull rods 15; each of the transfer vehicles includes a clamping device 11, clamping assemblies 4, and a driving assembly, the upper and lower ends of the clamping device 11 are respectively provided with the clamping assemblies 4, the clamping device 11 makes the clamping assemblies 4 at the upper and lower ends thereof move toward each other or move backwards, and the clamping assemblies 4 at the upper and lower ends thereof clamp the cabin 10; the driving assembly is arranged at the lower end of the clamping device 11, and is configured to drive the transfer vehicle to move; and when 4 transfer vehicles are combined, adjacent transfer vehicles are connected by the pull rods 15.

The transfer vehicle is provided with a monitoring unit, a central control unit, and a warning device, where the monitoring unit, the central control unit, and the warning device are electrically connected. The monitoring unit includes an infrared transmitter 13, an infrared receiver 14, an infrared range finder 81, and a camera 82, where the infrared transmitter 13 and the infrared receiver 14 are installed in one-to-one correspondence. When an infrared emitter is installed on the outer wall of a fixed block of one of the transfer vehicles, an infrared receiver is installed on the outer wall of the fixed block of another adjacent transfer vehicle to ensure that the signal emitted by the infrared transmitter can be received by the infrared receiver without interference by obstacles. The infrared range finder 81 and the camera 82 are arranged on the intermediate shaft of the self-propelled wheel 8 of the driving assembly. The central control unit is configured to receive control instructions from a controller, is connected with the clamping device 11 and the driving assembly, and controls the clamping device 11 and the driving assembly to work. When four transfer vehicles are in a fixed installation state against the cabin 10, the power support of the driving assembly enables to reduce the staff's effort in moving the cabin, so that the overall transfer process is easier and more relaxing.

The clamping device 11 includes a fixed block 1, a driving motor 111, a tie rod 112, a socket block 113, movable blocks 114, a slideway 115, and a connecting block 116; the fixed block 1 is in a bent "L" shape, a fixed base 2 is arranged on both the inner side walls of the fixed block 1, the outer side of the fixed block 1 of the clamping device 11 is provided with a plurality of built-in handles 12, a notch is formed on the outer wall of the fixed block 1, and a cylinder is installed inside the notch to form a handle structure; and the inside of the fixed block 1 is of a cavity structure;

the driving motor 111 is installed in a bending part on the top of the fixed block 1, the tie rod 112 is arranged in an inner cavity of the fixed block 1, the driving end of the driving motor 111 is fastened to one end of the tie rod 112 through a coupling, and the tie rod 112 is capable to rotate in the inner cavity of the fixed block 1 along its axis;

an outer wall of the socket block 113 is fixedly installed in the inner cavity of the fixed block 1, and an inner wall of the socket block 2 is sleeved in the middle of the tie rod 112 through rotation of a bearing;

The shape of the movable block 114 matches that of the fixed block 1, the movable block 114 is arranged in the inner cavity of the fixed block 1, the movable block 114 is provided with internal threads, the movable blocks 114 are respectively arranged on the upper and lower ends of the tie rod 112, the slideway 115 is arranged between the movable blocks at the upper and lower ends, and the movable block 114 is capable to move along the linear direction of the slideway 115;

the connecting block 116 is arranged at the end of the movable block 114 away from the tie rod 112, and a connecting rod 41 of the clamping assembly 4 is connected to the clamping device 11 through the connecting block 116.

The clamping assembly 4 includes a connecting rod 41, a support block 42, a clamping plate 43, and a fixed base 2;

one end of the connecting rod 41 penetrates the fixed base 2 and is connected to the connecting block 116 of the clamping device 11, the connecting rod 41 is slidably arranged in the fixed base 2, the other end of the connecting rod 41 is connected to the support block 42, and the inner side of the support block 42 is provided with the clamping plate 43;

the fixed base 2 is arranged on the inner side of the clamping device 11, the end portion of the fixed base 2 is provided with a limiting strip 3, and the limiting strip 3 is slidably connected with the side wall of the support block 42; chutes are formed on the two side walls of the support block 42 respectively, the limiting strip 3 is provided with protruding blocks along its length direction, the protruding blocks are slidably clamped in the chute, and the limiting strip is capable to ensure that the clamping assemblies at the upper and lower ends move towards each other along the vertical direction;

the clamping plate 43 is in contact with the three outer walls at the corners of the cabin; the clamping plate 43 includes a horizontal abutment plate and two longitudinal abutment plates, where the two longitudinal abutment plates are vertically connected and arranged at the bottom of the horizontal abutment plate, and inner walls of the horizontal abutment plate and the longitudinal abutment plate are provided with soft cushions 44; the inner side of the fixed base 2 is provided with a supporting plate 5, and the supporting plate 5 is in contact with the middle of the four corners of the cabin 10; a pressure sensor is installed on the inner wall of the soft cushion or the outer wall of the clamping plate, and the pressure sensor is connected to the monitoring unit, and is capable to measure the effect of contact between the cabin and the transfer tool. In the transfer process, many positions of the cabin are unevenly stressed. In this example, according to acquired data of stress when the cabin and the transfer tool are in contact, the degree of stress between the transfer vehicle and the cabin can be determined, so as to avoid damage to the cabin due to the structural factors of the transfer vehicle. When the pressure exceeds the threshold pressure in the central control unit, the central control unit controls the warning device to give an alarm.

Rotating shafts 45 are respectively arranged at the bottom ends of both sides of the clamping plate of the upper clamping assembly and the top ends of both sides of the clamping plate of the lower clamping assembly.

The driving assembly includes a support rod 6, a power assembly 7, and a self-propelled wheel 8; the power assembly 7 includes a battery 71, a steering device 72, and a power device 73; and the self-propelled wheel 8 is arranged at the corner of the bottom end of the power assembly 7;

the power assembly 7 is connected to the bottom end of the fixed block 1 of the clamping device 11 through the support rod 6, and the power assembly 7 drives the self-propelled wheel 8 to rotate; the battery 71 is electrically connected to a rotating device 72 and the power device 73, and the rotating device 72 and the power device 73 are both connected to the self-propelled wheel 8; and universal wheels 9 are respectively arranged at the bottom of both sides of the power assembly of the driving assembly. The rotating device and the power device in the technical solution belong to the prior art, and those skilled in the art can make conventional choices according to needs, which will not be described in detail here.

The pull rods 15 are telescopic rods, which are divided into two categories by length. The strength can be adjusted by contraction. Specifically, a long pull rod consists of three sections, and a short pull rod includes two sections. A knob 16 is arranged between telescopic joints of the pull rod 15, and length adjustment and fixing of the pull rod are realized by loosening or tightening the knob 16; hooks 17 are respectively arranged at both ends of the pull rod 15, a rotating shaft 45 is arranged on the side of the clamping assembly 4, and the pull rod 15 is clamped on the rotating shaft 45 by means of the hook 17. When 4 transfer vehicles are used in combination, the two ends of the pull rod 15 are movably connected to the rotating shafts 45 of the clamping assemblies 4 of two adjacent transfer vehicles through the hooks 17, and the pull rod 15 can be movably connected to the rotating shafts 45 of the upper and lower clamping assemblies 4 of the same transfer vehicle during storage.

Working principle: when the cabin needs to be fixed, one of the transfer vehicles should be installed at a corner of the cabin. After the controller sends a control instruction to the central control unit, the central control unit controls the driving motor 111 of the clamping device to work. After being started, the driving motor 111 will drive the tie rod 112 to rotate. During this movement, the tie rod 112 in the rotation process will move the movable blocks at the upper and lower ends along the slideway 115 towards each other. As the movable block 114 is fixedly connected to the connecting block 116, and the connecting block 116 is fixedly connected to the connecting rod 41 of the clamping assembly 4, so that the two clamping assemblies 4 located at the upper and lower ends of the fixed block 1 gradually approach until the clamping assemblies snap into the clamping slots of the cabin 10, to complete the fixing of the transfer vehicle and the cabin; the other three corners of the cabin are also fixed with the same steps;

After the fixation is completed, the clamping plate 43 of the clamping assembly 4 clamps and protects the corners of the cabin 10, where one horizontal abutment plate and two longitudinal abutment plates of the clamping plate 43 are in full contact with the three outer walls at the corners of the cabin 10; the supporting plate 5 is in contact with the middle of the four corners of the cabin 10; the above technical solution enables to reliably clamp all corners of the cabin 10, and the clamping assemblies at the eight corners of the cabin are connected by means of the pull rod 15, so that the transfer vehicle and the cabin 10 are completely fixed, thus ensuring the safety of the cabin in the transfer process, and further preventing the deformation of the cabin in the transfer process also because the soft cushion supports the middle of the cabin;

when four transfer vehicles are in a fixed installation state against the cabin, the central control unit controls the power assembly to work, the steering device 72 and the power device 73 are connected to the self-propelled wheel 8, and after the power is turned on, the self-propelled wheel is capable to rotate and move by itself; and the monitoring unit and the central control unit are both located on the transfer vehicle, where the monitoring unit is capable to verify the installation position of the transfer vehicle, and to ascertain whether all the transfer vehicles are in reliable transfer fit locations before moving, because the cabin may collide with other objects, doors and walls in the cruise ship during the movement process due to terrain, uneven force and other reasons; the monitoring unit is capable to verify the position of the transfer vehicle before the movement; in addition, the infrared range finder 81 and the camera 82 installed on a self-propelled wheel 8 observe in real time whether there is any obstacle in the transfer direction, measure the distance of the obstacle if any, and detect the state of the cabin 10 during the transfer and the positions of the surrounding objects; when the monitoring unit detects any abnormality of the cabin in the transfer process, the central control unit controls the power assembly to stop moving, and at the same time, sends out an alarm signal through the warning device; and this device is applied for the transfer of modular cabins, which can better monitor the status of the cabin and effectively avoid the damage to the cabin and the objects in the cruise ship, so that the overall cabin transfer process is more reliable and convenient.

The infrared light emitted by the infrared emitter 13 reaches the infrared receiver 14 on the opposite side. Before the module transfer, it can be reasonably perceived whether the positions of all transfer vehicles are reliable according to the states of emitting and receiving the infrared light. In the transfer process, when the cabin 10 is subject to abnormal stress or deformation, or is about to come into contact with any surrounding objects, if the infrared light emitted by the infrared transmitter 13 cannot be received by the infrared receiver 14, then it means that the current transfer status is unreliable, and in this case, the central control unit controls the warning device to give an alarm.

The pressure sensor of the present invention is capable to measure the effect of contact between the cabin and the transfer tool. In the transfer process, many positions of the cabin are unevenly stressed. In this example, according to acquired data of stress when the cabin and the transfer tool are in contact, the degree of stress between the transfer vehicle and the cabin can be determined, so as to avoid damage to the cabin due to the complex factors of the transfer vehicle. When the pressure exceeds the threshold pressure in the central control unit, the central control unit controls the warning device to give an alarm.

The above shows and describes the basic principles, main features and advantages of the present invention. The foregoing descriptions are merely preferred specific embodiments of the present invention, and are not intended to limit the technical features of the present invention. Any other implementations obtained by any person skilled in the art without departing from the technical solution of the present invention shall fall within the protection scope of the present invention.

What is claimed is:

1. A modular cabin transfer device suitable for large luxury cruise ships, comprising at least four transfer vehicles and at least four pull rods; each of the transfer vehicles comprises a clamping device (11), clamping assemblies (4), and a driving assembly, the upper and lower ends of the clamping device (11) are respectively provided with the clamping assemblies (4), the clamping device (11) makes the clamping assemblies (4) at the upper and lower ends thereof move toward each other or move away from the each other, and the clamping assemblies (4) at the upper and lower ends thereof clamp the cabin (10); the driving assembly is arranged at the lower end of the clamping device (11), and is configured to drive the transfer vehicle to move; and when the at least four transfer vehicles are combined, adjacent transfer vehicles are connected by the pull rods (15).

2. The modular cabin transfer device suitable for large luxury cruise ships according to claim 1, wherein the transfer vehicle is provided with a monitoring unit, a central control unit, and a warning device, wherein the monitoring unit, the central control unit, and the warning device are electrically connected; the monitoring unit comprises an infrared transmitter (13), an infrared receiver (14), an infrared range finder (81), and a camera (82), wherein the infrared transmitter (13) and the infrared receiver (14) are installed in one-to-one correspondence, and the infrared range finder (81) and the camera (82) are arranged on the driving assembly; the central control unit is connected with the clamping device (11) and the driving assembly, and controls the clamping device (11) and the driving assembly to work.

3. The modular cabin transfer device suitable for large luxury cruise ships according to claim 1, wherein the clamping device (11) comprises a fixed block (1), a driving motor (111), a tie rod (112), a socket block (113), movable blocks (114), a slideway (115), and a connecting block (116); the inside of the fixed block (1) is of a cavity structure;

the driving motor (111) is installed on the top of the fixed block (1), the tie rod (112) is arranged in an inner cavity of the fixed block (1), the driving end of the driving motor (111) is connected to one end of the tie rod (112), and the tie rod (112) is capable to rotate in the inner cavity of the fixed block (1) along its axis;

an outer wall of the socket block (113) is fixedly installed in the inner cavity of the fixed block (1), and an inner wall of the socket block (2) is sleeved in the middle of the tie rod (112) through rotation of a bearing;

the movable block (114) is provided with internal threads, the movable blocks (114) are respectively arranged on the upper and lower ends of the tie rod (112), the slideway (115) is arranged between the movable blocks at the upper and lower ends, and the movable block (114) is capable to move along the linear direction of the slideway (115);

the connecting block (116) is arranged at the end of the movable block (114) away from the tie rod (112), and the clamping assembly (4) is connected to the clamping device (11) through the connecting block (116).

4. The modular cabin transfer device suitable for large luxury cruise ships according to claim 3, wherein the fixed block (1) is in an "L" shape, and the driving motor (111) is installed in a bending part on the top of the fixed block (1); and a coupling is arranged between the driving end of the driving motor (111) and one end of the tie rod (112).

5. The modular cabin transfer device suitable for large luxury cruise ships according to claim 1, wherein the clamping assembly (4) comprises a connecting rod (41), a support block (42), a clamping plate (43), and a fixed base (2);

one end of the connecting rod (41) penetrates the fixed base (2) and is connected to the clamping device (11), the connecting rod (41) is slidably arranged in the fixed base (2), the other end of the connecting rod (41) is connected to the support block (42), and the inner side of the support block (42) is provided with the clamping plate (43); and the fixed base (2) is arranged on the inner side of the clamping device (11), the end portion of the fixed base (2) is provided with a limiting strip (3), and the limiting strip (3) is slidably connected with the side wall of the support block (42).

6. The modular cabin transfer device suitable for large luxury cruise ships according to claim 5, wherein the clamping plate (43) comprises a horizontal abutment plate and two longitudinal abutment plates, where the two longitudinal abutment plates are vertically connected and arranged at the bottom of the horizontal abutment plate, and inner walls of the horizontal abutment plate and the longitudinal abutment plate are provided with soft cushions (44); and the inner side of the fixed base (2) is provided with a supporting plate (5).

7. The modular cabin transfer device suitable for large luxury cruise ships according to claim 1, wherein the driving assembly comprises a support rod (6), a power assembly (7), and a self-propelled wheel (8); the power assembly (7) includes a battery (71), a steering device (72), and a power device (73); and the power assembly (7) is connected to the clamping device (11) through the support rod (6), and the power assembly (7) enables the self-propelled wheel (8) to rotate; the self-propelled wheel (8) is arranged at the bottom of the power assembly (7), the battery (71) is electrically connected to a rotating device (72) and the power device (73), and the rotating device (72) and the power device (73) are both connected to the self-propelled wheel (8).

8. The modular cabin transfer device suitable for large luxury cruise ships according to claim 1, wherein universal wheels (9) are arranged at the bottom of the driving assembly.

9. The modular cabin transfer device suitable for large luxury cruise ships according to claim 1, wherein a handle (12) is arranged on the outer side of the clamping device (11).

10. The modular cabin transfer device suitable for large luxury cruise ships according to claim 1, wherein the pull rod (15) is a telescopic rod, a knob (16) is arranged between telescopic joints of the pull rod (15), hooks (17) are respectively arranged at both ends of the pull rod (15), a rotating shaft (45) is arranged on the side of the clamping assembly (4), and the pull rod (15) is clamped on the rotating shaft (45) by means of the hook (17).

* * * * *